US006666441B2

(12) United States Patent
Grendahl

(10) Patent No.: US 6,666,441 B2
(45) Date of Patent: Dec. 23, 2003

(54) ANCHOR BOLT LOCATING JIG

(76) Inventor: Mark S. Grendahl, 117 Belmont Rd., Apple Valley, MN (US) 55124

( * ) Notice: Subject to any disclaimer, the term of this patent is extended or adjusted under 35 U.S.C. 154(b) by 0 days.

(21) Appl. No.: 09/840,947

(22) Filed: Apr. 24, 2001

(65) Prior Publication Data

US 2003/0168793 A1 Sep. 11, 2003

(51) Int. Cl.[7] ..... B25B 1/20

(52) U.S. Cl. ..... 269/43; 269/287; 52/295; 249/93

(58) Field of Search ..... 269/41, 43, 217, 269/234, 287, 42, 115, 116; 52/295; 249/91, 93, 210, 207

(56) References Cited

U.S. PATENT DOCUMENTS

| | | | | | |
|---|---|---|---|---|---|
| 1,036,025 | A | * | 8/1912 | Conklin | 269/116 |
| 1,209,761 | A | * | 12/1916 | Roos | 269/115 |
| 1,566,377 | A | * | 12/1925 | Currente | 269/115 |
| 1,632,918 | A | * | 6/1927 | Olson | 269/115 |
| 1,656,420 | A | * | 1/1928 | Christy | 269/115 |
| 1,660,905 | A | * | 2/1928 | Allman | 269/115 |
| 3,662,985 | A | * | 5/1972 | Parker | 269/307 |
| 3,724,801 | A | * | 4/1973 | Sels et al. | 249/48 |
| 3,790,121 | A | * | 2/1974 | Sels | 269/115 |
| 3,795,393 | A | * | 3/1974 | Melfi | 269/116 |
| 3,963,210 | A | | 6/1976 | Macklin | |
| 4,163,547 | A | * | 8/1979 | Jerome | 269/42 |
| 4,211,391 | A | * | 7/1980 | Strasser | 269/116 |
| 4,261,544 | A | | 4/1981 | Addison | |
| 4,736,554 | A | | 4/1988 | Tyler | |
| 5,060,436 | A | | 10/1991 | Delgado, Jr. | |
| 5,161,789 | A | * | 11/1992 | Rogers | 269/42 |
| 5,240,224 | A | | 8/1993 | Adams | |
| 5,332,191 | A | * | 7/1994 | Nolan | 249/155 |
| 5,836,132 | A | | 11/1998 | Weathersby | |

* cited by examiner

*Primary Examiner*—Joseph J. Hail, III
*Assistant Examiner*—Daniel Shanley
(74) *Attorney, Agent, or Firm*—Kinney & Lange, P.A.

(57) ABSTRACT

A jig (40) for locating anchor bolts in concrete standards of outdoor lighting installations comprises four complementary corner members (42) that can be interconnected and then secured together with fasteners (45) in the desired pattern. A second embodiment (70) comprised of male and female members (72, 74) is also disclosed.

12 Claims, 5 Drawing Sheets

ANCHOR BOLT LOCATING JIG

TECHNICAL FIELD

The present invention relates generally to locating fixtures or jigs. More particularly, this invention pertains to a new and unique jig for locating anchor bolts in the concrete standards of outdoor lighting poles.

BACKGROUND ART

Lighting poles and fixtures are used in various outdoor applications, such as parking lots, etc. These lighting poles are typically free-standing, mounted on concrete standards by means of anchor bolts that are cast in place when the concrete is poured to form the standard. Four such anchor bolts are typically used in each standard, arranged in a square pattern, the size of which depends upon the particular lighting pole and fixture. The base of the lighting pole includes a corresponding pattern of mounting holes that fit over the anchor bolts and are then tightened down by nuts.

When concrete standards for such lighting poles are being formed, it is important that the anchor bolts be properly located. They must not only be arranged in the correct pattern, but must also be aligned vertically and parallel with each other, for proper mounting of the lighting fixture. Moreover, it is important that this be done when the concrete standard is poured because any mislocation or misalignment of the anchor bolts cannot be corrected after the concrete has set.

Typically, the postioning or location of such anchor bolts has been done manually, or sometimes with the aid of a piece of wood with four radial slots arranged about a central opening. However, this is time consuming and imprecise at best. Repeatability has been a problem, especially when the concrete standards are being formed under adverse weather conditions or in low light. Also, even when proper spacing is achieved, misalignment can still occur due to the length of the anchor bolts and the depth to which they extend down into the concrete standards. Heretofore, there has not been available an adjustable jig for properly locating such anchor bolts.

A need has thus arisen for a adjustable jig for locating anchor bolts in the concrete standards of outdoor lighting poles.

SUMMARY OF INVENTION

The present invention comprises an adjustable jig for locating anchor bolts in the concrete standards of outdoor lighting poles, which overcomes the foregoing and other difficulties associated with the prior art. In accordance with the invention there is provided a new and unique jig or fixture that is readily adjustable, depending upon the particular pattern spacing desired, and which also provides for parallel alignment of the anchor bolts when the concrete standards are poured to facilitate proper mounting of outside lighting poles and fixtures. The anchor bolt locating jig herein comprises four complementary corner members which readily fit together and are then secured to form a rigid box, for receiving the anchor bolts. Two embodiments are disclosed. The anchor bolt locating jig herein is compact and economical to manufacture, and is adapted for use without special training or expertise.

BRIEF DESCRIPTION OF DRAWING

A better understanding of the invention can be had by reference to the following Detailed Description in conjunction with the accompanying Drawing, wherein.

DETAILED DESCRIPTION

Figure 1:
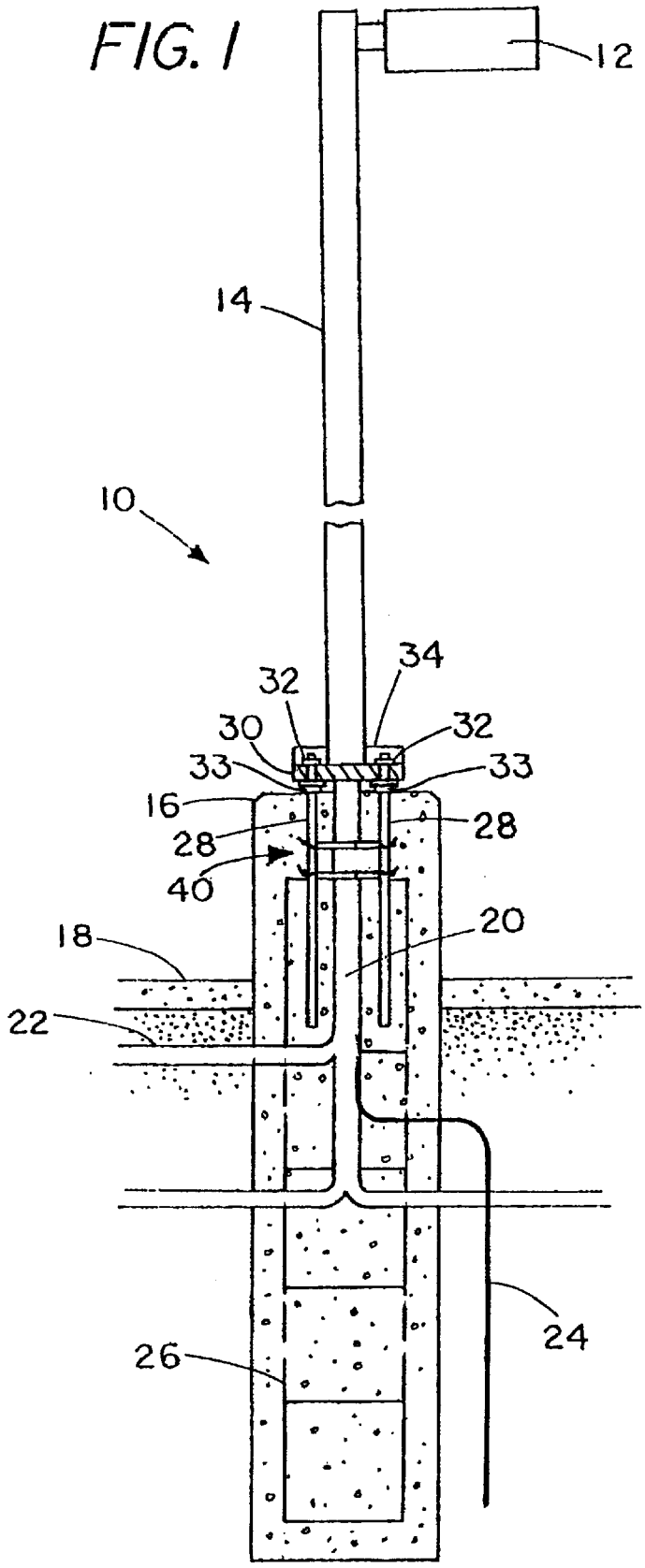
FIG. 1 is an outdoor lighting pole installation with an anchor bolt locating jig incorporating a first embodiment of the invention.

Referring now to the Drawing, wherein like reference numerals designate like or corresponding elements throughout the views, and particularly referring to FIG. 1, there is shown an outdoor lighting installation 10 incorporating the invention. The installation 10 is of the free-standing type usually found in parking lots, etc. Installation 10 includes a lighting fixture 12 affixed to a pole 14 mounted on a standard 16 extending through the surface 18 of the parking lot, which is typically bituminous or asphalt.

The standard 16, which is typically formed of concrete, is usually about 2 feet in diameter, extending about 2.5 feet above the surface 18, and about 7.0 feet below it into the ground. The standard 16 includes PVC conduits 20 and 22 forming vertical and horizontal raceways for the electical lines (not shown), a ground rod 24, interconnecetd reinforcing bars 26, and four anchor bolts 28. The base 30 of the lighting pole 14 is secured between nuts 32 and 33 on the threaded upper ends of the anchor bolts 28, which are enclosed by a cover 34. As will be explained more fully hereinafter, the anchor bolts 28 are held in position during pouring of the concrete standard 16 by the adjustable locating jig 40 of the invention, which facilitates proper spacing and alignment.

Figure 2:
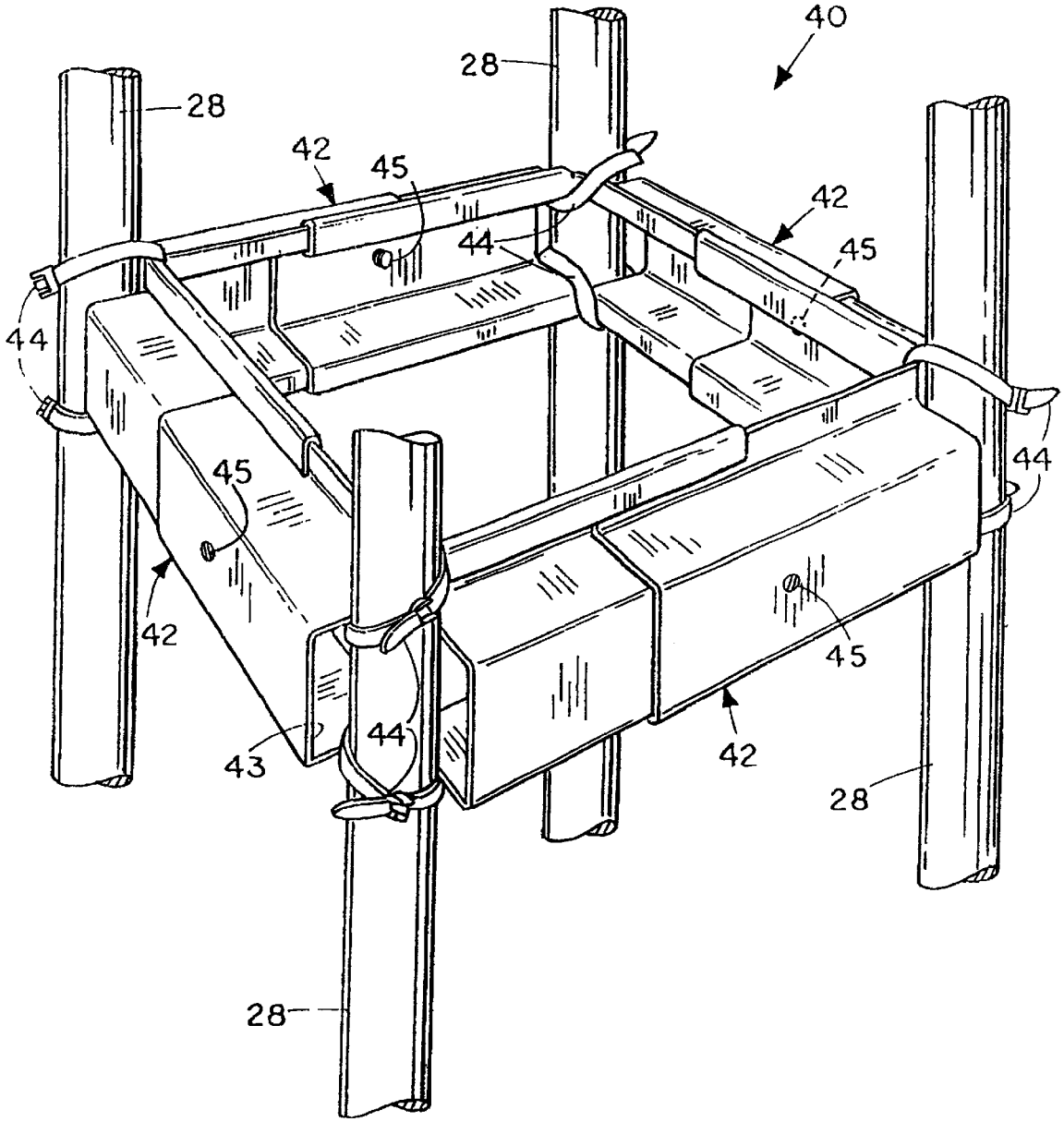
FIG. 2 is an enlarged perspective view of the anchor bolt locating jig herein.
Figure 3:
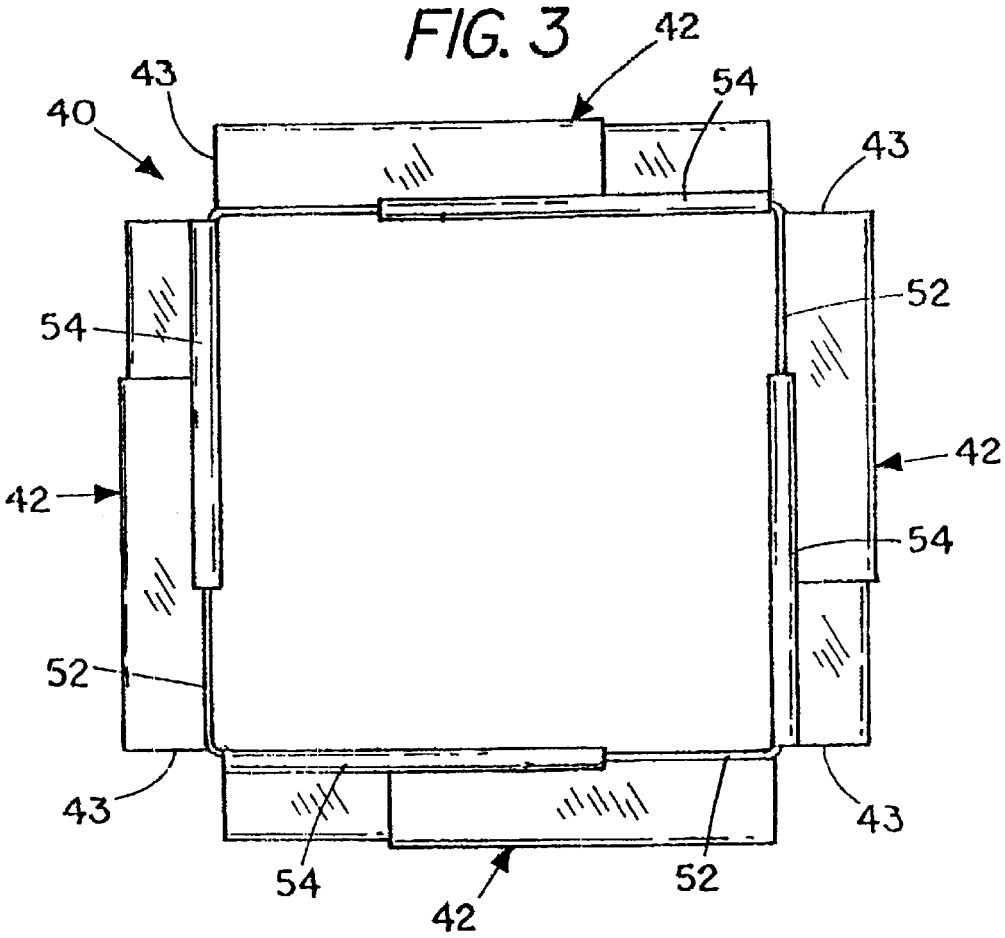
FIG. 3 is a plan view thereof.

Referring now to FIGS. 2 and 3, the adjustable locating jig 40 of the invention comprises four corner members 42 interconnected at their ends. The center of jig 40 is open to fit over the vertical conduit 20. Each corner member 42 is bent in the middle to form a notch 43 for receiving an anchor bolt 28, which is secured thereto by wire ties 44. The corner members 42 are of generally channel-like configuration for rigidity, with the adjacent ends of each being interconnected by suitable fasteners 45, such as screws, in the desired position.

Figure 4:
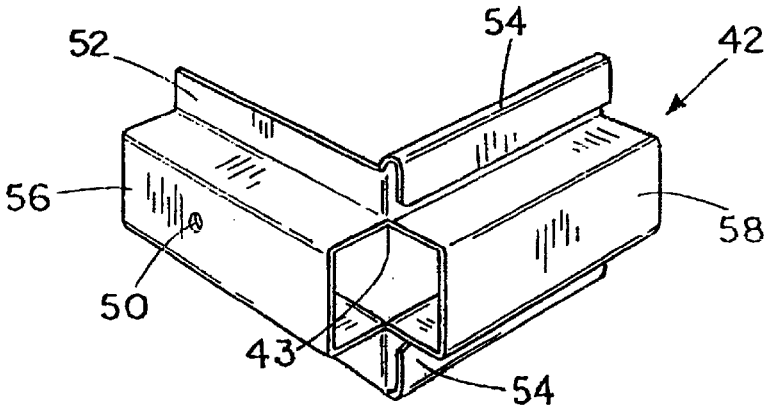
FIG. 4 is a perspective view of a corner member thereof before assembly into the jig.
Figure 5:
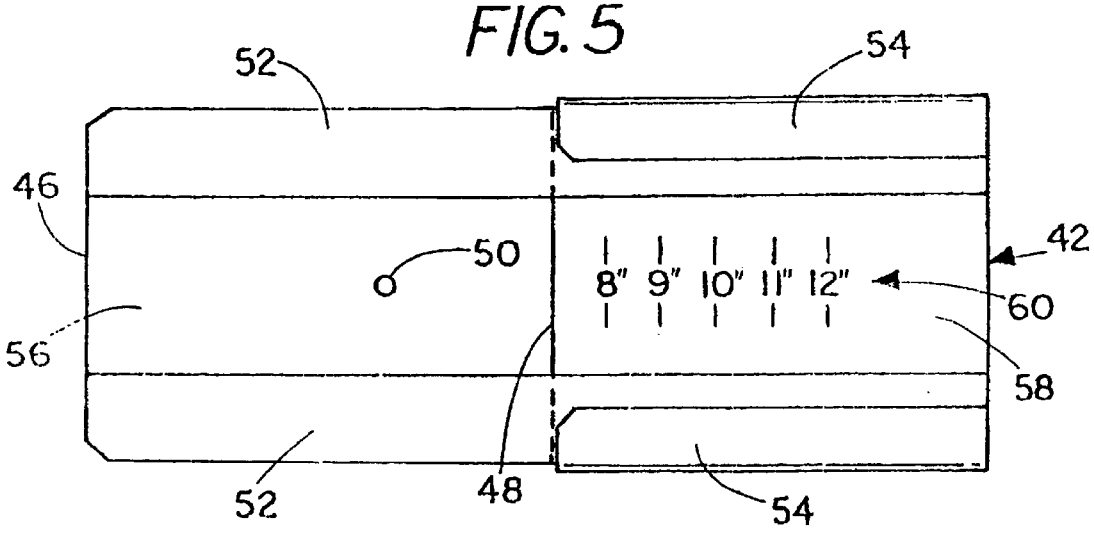
FIG. 5 is a side view of a corner member after forming but before folding.
Figure 6:
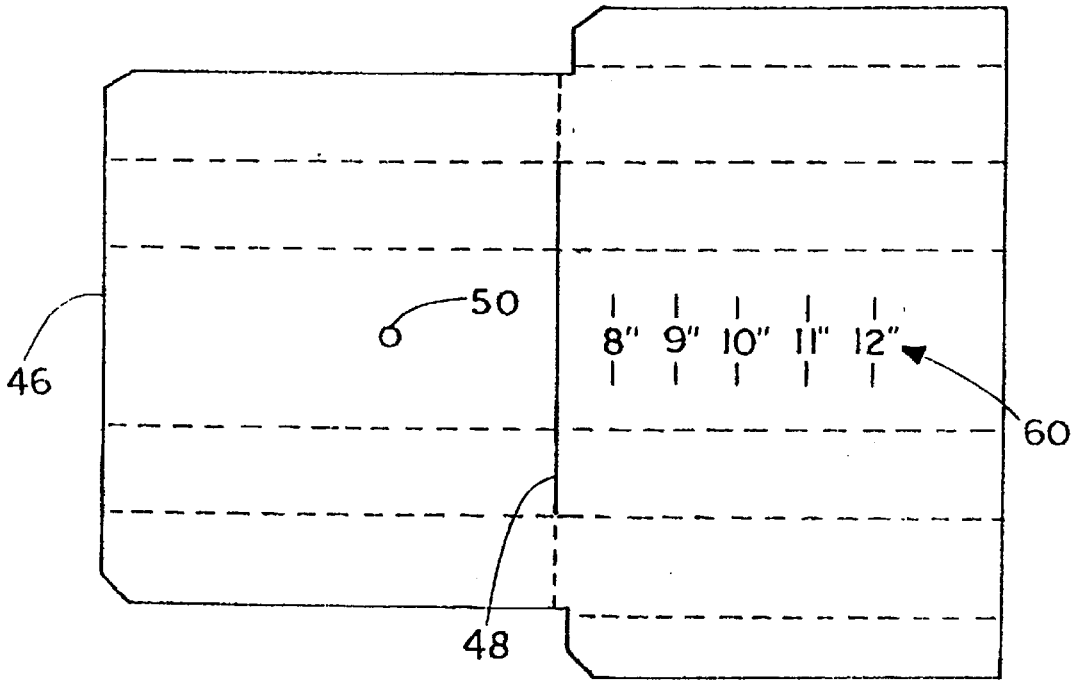
FIG. 6 is a top view of a blank from which a corner member can be formed.

Referring now to FIGS. 4–6, each corner member 42 is preferably formed from a blank 46 of suitable rigid material. For example, in the preferred embodiment, 18 gauge galvanized metal is used, although any suitable material could be used.

FIG. 6 shows a flat blank 46 after punchout, with a vertical slit or cut 48 and a fastening hole 50 therein, but before forming along the fold lines shown in phantom. Cut 48 does not extend completely between the opposite longitudinal sides of the blank 46.

FIG. 5 shows the blank 46 after forming with longitudinal flanges 52, inwardly folded edges 54, and raised middle portions 56 and 58 separated by slit or cut 48. The inwardly folded edges 54 serve as female guideways for slidably receiving the male flanges 52 from an adjacent corner member 42. The raised middle portions 56 and 58 are preferably of different sizes for slidably receiving the opposite portion of an adjacent member 42 without interference. In the preferred embodiment, portion 56 is slightly higher and wider than portion 58 so that the members 42 will fit together. The overall dimensions of each member 42 in this position are about four inches tall, ten inches long and one inch deep.

FIG. 4 shows a corner member 42 after forming and bending about a line extending through the middle slit or cut 48 at about a right angle to form the corner notch 43 between the raised portions 56 and 58. It will be appreciated that this provides several spaced apart edges for supporting an anchor bolt 28 therein so that all of the bolts will be in proper alignment when secured by wire ties 44. This comprises an important feature of the invention.

In the preferred embodiment, spaced-apart markings 60 are provided on the relatively lower portion 58 to facilitate setting the jig 40 to the desired size after the members 42 have been inserted into one another on site, after which they are secured in place with fasteners 45 extending through holes 50 and the underlying portions 58 of the adjacent member, so that the jig 40 is rigid unit before attachment of the anchor bolts 28. The ends of each member 42 are preferably chamfered as shown to facilitate insertion.

Figure 7:
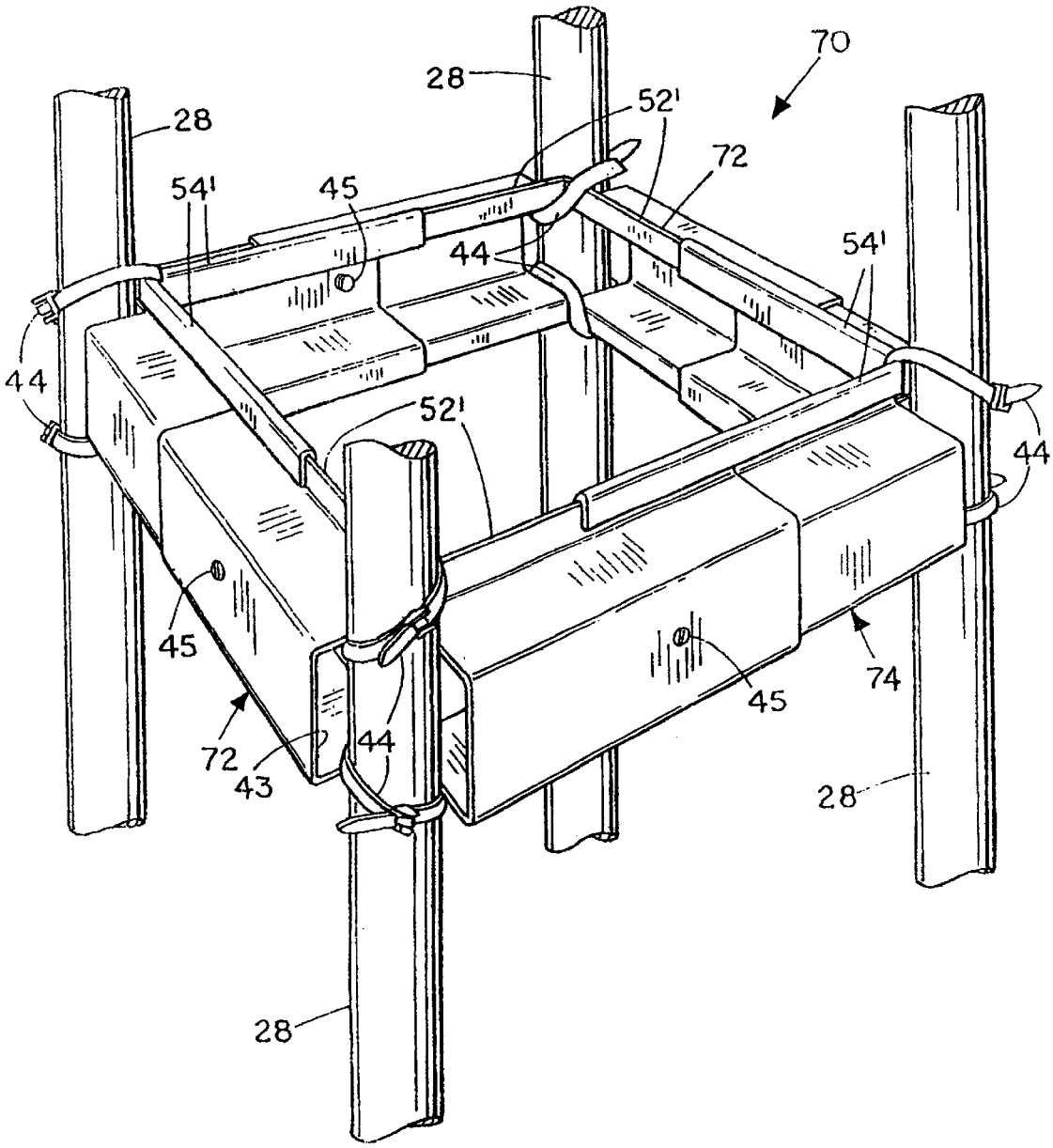
FIG. 7 is an enlarged perspective view of an anchor bolt locating jig incorporating a second embodiment of the invention.

Referring now to FIG. 7, there is shown an anchor bolt locating jig 70 incorporating a second embodiment of the invention. Since jig 70 utilizes components or features that are similar to those of jig 40 of the first embodiment, they have been identified with the same reference numerals, but with prime (') notations for differentiation.

The primary difference between the embodiments is that jig 70 is comprised of two types of corner members 72 and 74, whereas jig 40 is comprised of only one type of corner member 42. In particular, each male corner member 72 includes flanges 52', while each female corner member 74 includes inwardly folded edges 54,' extending continuosly between the ends thereof, so that they are arranged in alternate order. In other words, corner members 72 and 74 are complementary, instead of opposite ends of each corner member 42 being complementary. Otherwise, the jigs 40 and jig 70 fit together and function in similar fashion.

The locating jigs 40 and 70 herein are used as follows. After the hole has been dug, the cardboard forming tube (not shown) is inserted into the hole, followed by placement of the electrical conduits 20 and 22, the ground rod 24 and the reinforcing bars 26 therein. Concrete is then poured into the forming tube (not shown) near its top and that of conduit 20. The anchor bolts 28 are secured to the locating jig about 18 inches from their upper ends, after which this subassembly is pushed down into the wet concrete until the jig is submerged leaving only the upper ends of the anchor bolts 28 exposed. Since the jig holds the anchor bolts in the desired spacing, they can easily be checked and adjusted as a unit to make sure they are vertical and plumb in the proper position while the concrete is wet. After the concrete hardens to complete the standard 16, the forming tube (not shown) is peeled away and the lower leveling nuts 33 are set, after which the lighting pole 14 is lifted into position and secured with nuts 32. The electrical connections are made and cover 34 is secured to complete the installation.

From the foregoing, it will be appreciated that the present invention comprises an anchor bolt locating jig having several advantages over the prior art. The locating jig herein is of variable size, and once set in the desired size, can then be secured with screws to form a rigid unit. The corner notches not only maintain accurate spacing of the anchor bolts, but also keep them in proper alignment when the subsassembly is cast into the concrete standard. This avoid individually setting and adjusting each anchor bolt. The jig herein is of relatively simple, inexpensive construction. No special training or expertise is required to use the device. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any equivalents, modifications and/or rearrangements of elements falling within the scope of the invention as defined by the following claims.

What is claimed is:

1. An adjustable jig for locating anchor bolts in outdoor lighting installations, which comprises:

four corner members disposed in a rectangular arrangement, said corner members each having opposite complementary ends adapted for slidable overlapping engagement with an end of an adjacent corner member;

each corner member including a generally transverse notch for receiving an anchor bolt therein;

means for interconnecting said corner members together in a predetermined position to form a rigid unit; and means for securing the anchor bolts to said corner members in mutually parallel, aligned relationship generally transverse to the jig.

2. The adjustable jig of claim 1, wherein said corner members are of generally channel-like cross section.

3. The adjustable jig of claim 1, wherein said corner members are of generally L-shape bent in about the middle, with both ends of two of said corner members being of predetermined male configuration, and both ends of the other two corner members being of predetermined female configuration, for mating engagement in alternating sequence.

4. The adjustable jig of claim 1, wherein said corner members are of generally L-shape bent in about the middle, with opposite ends of each corner member being of predetermined male and female configurations, for mating engagment with adjacent corner members.

5. The adjustable jig of claim 1, wherein said corner members are formed from galvanized metal.

6. The adjustable jig of claim 1, wherein said means for interconnecting said corner members comprises threaded fasteners extending through overlapping ends of adjacent corner members.

7. An adjustable jig for locating anchor bolts in outdoor lighting installations, which comprises:

members of four corner members disposed in a rectangular arrangement, said corner members having opposite complementary ends adapted for slidable overlapping engagement with an end of an adjacent corner member;

each corner member including an outside notch for receiving an anchor bolt therein;

means for interconnecting said corner members together in a predetermined position; and means for securing the anchor bolts to said corner members, said means for securing the anchor bolts to said corner members comprising wire ties.

8. An adjustable jig for locating anchor bolts in outdoor lighting installations, which comprises:

four corner members disposed in a rectangular arrangement;

each corner member having opposite mating male and female ends adapted for slidable overlapping engagement with an end of an adjacent corner member;

each corner member including an outside, generally transverse notch for receiving an anchor bolt therein; and means for interconnecting said corner members together in a predetermined position to form a rigid unit.

9. The adjustable jig of claim 8, wherein said corner members are of generally channel-like cross section.

10. The adjustable jig of claim 8, wherein said corner members are formed from galvanized metal.

11. The adjustable jig of claim 8, wherein said means for interconnecting said corner members comprises threaded fasteners extending through overlapping ends of adjacent corner members.

12. The adjustable jig of claim 8, further including:

means for securing the anchor bolts to said corner members in mutually parallel, aligned relationship transverse to the jig.

* * * * *

UNITED STATES PATENT AND TRADEMARK OFFICE

CERTIFICATE OF CORRECTION

PATENT NO. : 6,666,441 B2
DATED : December 23, 2003
INVENTOR(S) : Mark S. Grendahl It is certified that error appears in the above-identified patent and that said Letters Patent is hereby corrected as shown below:

Column 4,
Line 53, delete "members of"

Signed and Sealed this

Second Day of August, 2005

JON W. DUDAS
*Director of the United States Patent and Trademark Office*